US006365334B1

(12) United States Patent
Poslusny et al.

(10) Patent No.: US 6,365,334 B1
(45) Date of Patent: Apr. 2, 2002

(54) PHOTOGRAPHIC ELEMENTS CONTAINING ARYLOXYPYRAZOLONE COUPLERS AND SULFUR CONTAINING STABILIZERS

(75) Inventors: Jerrold Neal Poslusny; Paul Barrett Merkel; Lawrence Glenn Anderson; Jared Ben Mooberry, all of Rochester; David Hales Bown, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/141,457

(22) Filed: Oct. 22, 1993

(Under 37 CFR 1.47)

(51) Int. Cl.[7] ..... G03C 7/384; G03C 7/388; G03C 7/392

(52) U.S. Cl. ..... 430/551; 430/555

(58) Field of Search ..... 430/551, 555, 430/957

(56) References Cited

U.S. PATENT DOCUMENTS

| | | | | | |
|---|---|---|---|---|---|
| 3,419,391 | A | | 12/1968 | Young | 96/56.5 |
| 3,519,429 | A | | 7/1970 | Lestina | 96/100 |
| 3,619,195 | A | | 11/1971 | Van Campen | 96/100 |
| 3,907,571 | A | | 9/1975 | Arai et al. | 96/100 |
| 4,113,488 | A | | 9/1978 | Yamada et al. | 96/56 |
| 4,246,333 | A | * | 1/1981 | Fuseya et al. | 430/957 |
| 4,248,962 | A | | 2/1981 | Lau | 430/382 |
| 4,345,016 | A | * | 8/1982 | Takahashi et al. | 430/551 |
| 4,374,196 | A | | 2/1983 | Herz | 430/505 |
| 4,378,428 | A | | 3/1983 | Farina et al. | 435/7 |
| 4,421,845 | A | | 12/1983 | Uemura et al. | 430/544 |
| 4,443,536 | A | * | 4/1984 | Lestina | 430/553 |
| 4,451,557 | A | | 5/1984 | Lok et al. | 430/505 |
| 4,511,649 | A | * | 4/1985 | Ogawa et al. | 430/555 |
| 4,540,438 | A | | 9/1985 | Gutmann et al. | 106/97 |
| 4,540,657 | A | | 9/1985 | Krishnamurthy | 430/546 |
| 4,564,587 | A | | 1/1986 | Watanabe et al. | 430/505 |
| 4,585,728 | A | | 4/1986 | Furutachi et al. | 430/372 |
| H156 | H | * | 11/1986 | Ozawa et al. | 430/555 |
| 4,692,529 | A | | 9/1987 | Masuda et al. | 546/141 |
| 4,708,927 | A | * | 11/1987 | Okamura et al. | 430/957 |
| 4,724,198 | A | | 2/1988 | Yamada et al. | 430/506 |
| 4,749,644 | A | * | 6/1988 | Tosaka et al. | 430/555 |
| 4,749,645 | A | * | 6/1988 | Goddard et al. | 430/551 |
| 4,770,987 | A | | 9/1988 | Takahashi et al. | 430/546 |
| 4,782,011 | A | * | 11/1988 | Goddard et al. | 430/551 |
| 4,783,398 | A | * | 11/1988 | Takada et al. | 430/555 |
| 4,933,271 | A | | 6/1990 | Rody et al. | 430/512 |
| 4,973,535 | A | | 11/1990 | Merkel et al. | 430/17 |
| 4,977,073 | A | | 12/1990 | Ishige et al. | 430/549 |
| 4,985,336 | A | * | 1/1991 | Ichijima et al. | 430/555 |
| 5,006,665 | A | | 4/1991 | Rody et al. | 549/28 |
| 5,017,465 | A | | 5/1991 | Nishijima | 430/551 |
| 5,070,007 | A | | 12/1991 | Rody et al. | 430/551 |
| 5,232,821 | A | | 8/1993 | Merkel et al. | 430/372 |
| 5,298,368 | A | | 3/1994 | Merkel et al. | 430/372 |
| 5,360,711 | A | * | 11/1994 | Negoro et al. | 430/551 |

FOREIGN PATENT DOCUMENTS

| | | | | |
|---|---|---|---|---|
| DE | 4040472 | | 6/1992 | |
| EP | 0 514 896 | | 11/1992 | |
| JP | 1098350 | * | 5/1986 | 430/551 |
| JP | 1250641 | * | 11/1986 | 430/551 |
| JP | 2091944 | * | 4/1987 | 430/555 |
| JP | 2211650 | * | 9/1987 | 430/555 |
| JP | 2265660 | * | 11/1987 | 430/551 |
| JP | 3052138 | * | 3/1988 | 430/555 |
| JP | 3220142 | * | 9/1988 | 430/551 |
| JP | 4050835 | * | 2/1992 | 430/957 |

* cited by examiner

*Primary Examiner*—Richard L. Schilling
(74) *Attorney, Agent, or Firm*—Arthur E. Kluegel

(57) ABSTRACT

A photographic element having a layer comprising a silver halide emulsion, a 1-aryl-4-aryloxy-2-pyrazolin-5-one magenta dye forming coupler, and a sulfide, sulfoxide or sulfone compound. Such elements exhibit good activity and stability of the magenta coupler. Preferably, the foregoing magenta dye forming coupler has the structure of Ia or Ib below, while the sulfide, sulfoxide and sulfone compounds have the structure VI, VII or VIII below:

Ia

Ib

VI

VII

VIII

Where R1, R2, R3, n, R8 and R9 are defined in the specification.

3 Claims, No Drawings

PHOTOGRAPHIC ELEMENTS CONTAINING ARYLOXYPYRAZOLONE COUPLERS AND SULFUR CONTAINING STABILIZERS

FIELD OF THE INVENTION

The present invention relates to photographic elements having a layer containing both a 1-aryl-4-aryloxy-2-pyrazolin-5-one magenta coupler, and a sulfide, sulfoxide or sulfone compound.

BACKGROUND OF THE INVENTION

In a silver halide photographic element, a color image is formed when the material is exposed to light and then subjected to color development with a primary amine developer. The color development results in imagewise reduction of silver halide and production of oxidized developer. The oxidized primary amine developer subsequently reacts with one or more incorporated dye-forming couplers to form dye in an imagewise fashion. Some couplers, referred to as DIR couplers, release a development inhibitor compound or fragment upon coupling with the oxidized primary amine developer. Further, some of these DIR couplers release the inhibitor compound or fragment with a time delay. These are sometimes referred to as DIAR couplers.

A variety of magenta dye-forming coupler types have been used in color photographic materials. These include pyrazoloazole couplers, 1-phenyl-3-acylamino-2-pyrazolin-5-one couplers and 1-phenyl-3-anilino-2pyrazolin-5-one couplers. U.S. Pat. Nos. 3,419,391, 3,519,429 and 4,248,962, 4,585,728, 4,692,529, 4,724,198, and 4,977,073 disclose couplers which include 1-aryl-4-aryloxy-2-pyrazolin-5-one type couplers.

Many compounds, including sulfur-containing addenda, have been previously tried or suggested for use in conjunction with couplers in an effort to improve coupler activity. For example, Rody et al disclose cyclic sulfide, sulfoxide and sulfone stabilizers in U.S. Pat. Nos. 4,933,271, 5,006,665 and 5,070,007. Cyclic sulfoxide and sulfone stabilizers are also disclosed in U.S. Pat. No. 5,017,465. Sulfone-containing addenda are used in combination with magenta dye-forming couplers in U.S. Pat. No. 4,770,987. Yamada et al disclose combinations of magenta dye-forming couplers, phenolic compounds and sulfide or sulfoxide compounds in U.S. Pat. No. 4,113,488. Combinations of sulfoxide or sulfone compounds and pyrazolotriazole magenta dye-forming couplers are disclosed in U.S. Pat. No. 5,232,821 of Merkel et al.

Magenta dye-forming coupler compositions of high activity that efficiently react with oxidized developer are, however, still needed. There is also a need for magenta dye-forming DIR (including DIAR) coupler compositions that efficiently release development inhibitors.

SUMMARY OF THE INVENTION

It has been found that while 1-aryl-4-aryloxy-2pyrazolin-5-one type couplers can have high activity and high dye forming ability, such couplers tend to be unstable toward aerial oxidation and are therefore impractical. While various compounds might be considered for use with such couplers in an attempt to alleviate the foregoing problem, we have found that surprisingly certain sulfide, sulfoxide or sulfone addenda when used in combination with 1-aryl-4-aryloxy-2-pyrazolin-5-one magenta dye-forming couplers can dramatically improve their oxidative stability.

The present invention therefore provides a photographic element comprising a silver halide emulsion having a layer comprising a silver halide emulsion, a 1-aryl-4-aryloxy-2pyrazolin-5-one magenta dye forming coupler, and a sulfide, sulfoxide or sulfone compound.

Embodiments of the Invention

In the present invention, it is preferred that the magenta dye forming coupler has structure Ia or Ib, below, and the sulfide, sulfoxide or sulfone compounds have structures VI, VII and VIII, respectively:

Ia

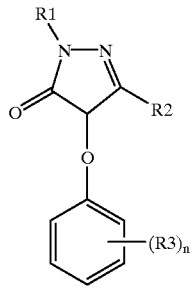

Ib

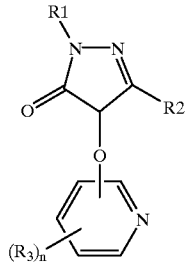

wherein:

R1 is an aryl group;

R2 is an alkyl group, an acylamino group, an anilino group, a carbamoyl group or an alkoxy group;

R3 is a substituent any of which may be the same or different; and n is an integer from 0 to 4;

VI

VII

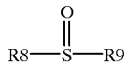

VIII

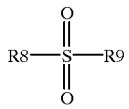

wherein:

R8 and R9 are independently an alkyl group, an alkylene group, an alkenyl group or an aryl group, or R8 and R9 may together form a ring including the sulfur atom, the total number of carbon atoms in R8 and R9 together being at least 12.

It should be noted that throughout this application a reference to any type of "group" includes both the unsubstituted and substituted group described. Various substituents can include known substituents, such as halogen (for example, chloro, fluoro, bromo, iodo), alkoxy (for example, methoxy, ethoxy), substituted or unsubstituted alkyl (for example, methyl, trifluoromethyl), alkenyl, thioalkyl (for example, methylthio or ethylthio), substituted and unsubstituted aryl (for example, phenyl, thienyl, furyl, pyrrolyl) and others known in the art. Alkyl substituents may specifically include "lower alkyl", that is having from 1 to 6 carbon atoms, for example, methyl, ethyl, and the like. Additionally, substituents may form bridged linkages. Further, with regard to any alkyl group, alkylene group or alkenyl group, it will be understood that these can be branched or unbranched and include ring structures.

Preferably R2 is an alkyl group. Especially preferred are couplers of structure Ia or Ib, in which R2 is of structure IIa or IIb, below:

IIa

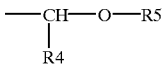

IIB

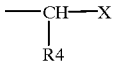

wherein:

R4 is hydrogen, an alkyl group or an aryl group;

R5 is an aryl group or an alkyl group; and

X is an amino group, an anilino group, a carbonamido group, a sulfonamido group, an acyloxy group, an alkoxy carbonyl group, a carbamoyl group, a sulfamoyl group, an alkylthio group, an arylthio group, an alkyl sulfoxide group, an aryl sulfoxide group, an alkyl sulfonyl group or an aryl sulfonyl group.

It is preferable that the total number of carbon atoms in R1, R2 and R3 taken together be at least 14, and more preferably at least 16 to minimize coupler water solubility and wandering.

An anilino group for R2 is less preferred because it tends to reduce coupler stability toward aerial oxidation. When R2 is an acylamino or an anilino group, it is preferred that at least one R3 is an electron-withdrawing group to improve coupler stability. Electron withdrawing groups are discussed in March, *Advanced Organic Chemistry,* pages 20–21, 228–229, 386–387, 494–497. In particular, preferred electron withdrawing substituents would have a Hammett $\sigma_p$ constant of greater than 0.1 and preferably between 0.1 and 1.0 (for example, between any of 0.3, 0.4, 0.5 or 0.6 and 1.0). Hammett $\sigma_p$ values are discussed in *Advanced Organic Chemistry* 3rd Ed., J. March, (John Wiley Sons, NY; 1985). Note that the "p" subscript refers to the fact that the σ values are measured with the substituents in the para position of a benzene ring. Additional tables relating to Hammett $\sigma_p$ constants can be found in *Chemical Reviews* Volume 91, pages 165–195 (authored by C Hansch et al.). Examples of electron-withdrawing groups include nitro, cyano, sulfamoyl, sulfonamido, alkylsulfonyl, arylsulfonyl, carbamoyl, carbonamido, alkoxycarbonyl, aryloxycarbonyl and trifluoromethyl groups and halogen atoms, such as chlorine and fluorine.

Also particularly useful for the practice of this invention are development inhibitor-releasing couplers in which one of R3 contains a development inhibitor group that is released after the aryloxy group couples off when the 1-aryl-4-aryloxy-2-pyrazolin-5-one coupler reacts with oxidized developer. Particularly useful inhibitor-releasing couplers of structure Ia or Ib are those in which the 4-aryloxy coupling-off group shown in formula Ia or Ib is of structure III, IV or V, below:

III

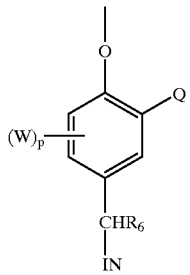

IV

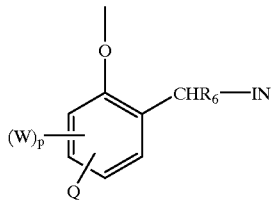

V

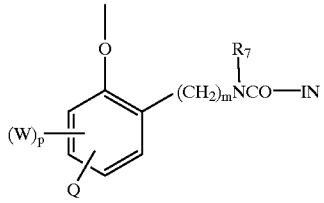

wherein

Q and W are electron-withdrawing groups, any of which may be the same or different;

p is 0, 1 or 2;

m is 0 or 1;

R6 is hydrogen, phenyl or an alkyl group; and

R7 is an alkyl group containing 1 to 10 carbon atoms or a phenyl group; and

IN is a development inhibitor moiety.

In formulae IV and V above, Q is preferably in the para position with respect to the oxygen.

Development inhibitor moieties, IN, useful for the couplers of this invention include oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles and benzisodiazoles.

With regard to the sulfides, sulfoxides and sulfones of this invention described above, as already mentioned when R8 or R9 is an alkyl group, an alkylene group, an alkenyl group any of those groups can be branched or unbranched and include ring structures. Substituents which may be present on R8 or R9 when they are alkyl, alkylene or alkenyl groups, include one or more substituents selected from the group consisting of aryl, alkoxy, aryloxy, alkoxycarbonyl, aryloxycarbonyl, acyloxy, carbonamido, carbamoyl, sulfonamido and sulfamoyl groups and halogen atoms. When R8 or R9 is an aryl group, substituents which may be present include substituents selected from the group consisting of alkyl, alkoxy, aryloxy, alkoxycarbonyl, aryloxycarbonyl, acyloxy, carbonamido, carbamoyl, sulfonamido, sulfamoyl groups and halogen atoms.

Preferably, both R8 and R9 are unsubstituted alkyl groups, which may be either unbranched or branched. It is also preferred that the total number of carbon atoms in R8 and R9 be at least 16 to minimize water solubility and wandering of the sulfide, sulfoxide or sulfone compound. Sulfides of formula VI and sulfoxides of formula VII are preferred for their stabilizing ability.

With regard to the location of the coupler and sulfur containing compound, preferably they are together in the same dispersion (specifically, in the same drops of a solvent dispersion, typically the coupler solvent, in the layer).

Useful coated levels of the 1-aryl-4-aryloxy-2-pyrazolin-5-one magenta dye-forming couplers of the invention range from about 0.005 to 2.0 g/sq m, depending on the coupler type (note "sq m"=square meters). Imaging couplers would typically be coated in the 0.05 to 2.00 g/sq m range (preferably 0.10–1.00 g/sq m), while inhibitor-releasing couplers would typically be used in the 0.005 to 0.50 g/sq m range (preferably 0.01–0.25 g/sq m). Useful coated mole ratios of the 1-aryl-4-aryloxy-2pyrazolin-5-one couplers to sulfide, sulfoxide or sulfone compound range from about 1:0.05 to about 1:5, or more typically from about 1:0.1 to about 1:2.

The couplers of this invention are usually utilized by dissolving them in high-boiling coupler solvents and then dispersing the organic coupler plus coupler solvent mixtures as small particles (in particular, droplets) in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. The sulfides, sulfoxides or sulfone compounds of this invention may serve as the sole high-boiling solvents for the 1-aryl-4-aryloxy-2pyrazolin-5-one couplers of this invention. Alternatively, other high-boiling coupler solvents may be used together with the sulfides, sulfoxide or sulfone compounds of this invention, including aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. 2-hexyl-1-decanol), carbonamides (e.g. N,N-dibutyldodecanamide or N-butylacetanilide), sulfonamides (e.g. N,N-dibutyl-p-toluenesulfonamide) or hydrocarbons (e.g. dodecylbenzene). It is preferred that the 1-aryl-4-aryloxy-2pyrazolin-5-one coupler plus sulfide, sulfoxide or sulfone combinations of this invention not be coated with a phenol coupler solvent or other phenol compound in the same dispersion (that is, in the same droplets of a dispersion) or same layer.

An alternate embodiment of the present invention provides a 1-aryl-4-aryloxy-2pyrazolin-5-one magenta dye forming coupler which has a sulfoxide group. Such a coupler may be used with or without the sulfide, sulfoxide or sulfone compounds described above. The foregoing coupler could be the same as any of those described above for use with the sulfide, sulfoxide or sulfone compounds described. The substituents on the sulfoxide could include any of those groups described above for R8 and R9.

Examples of 1-aryl-4-aryloxy-2pyrazolin-5-one magenta dye-forming couplers useful for the practice of this invention include, but are not limited to, A1–A21, below:

A1

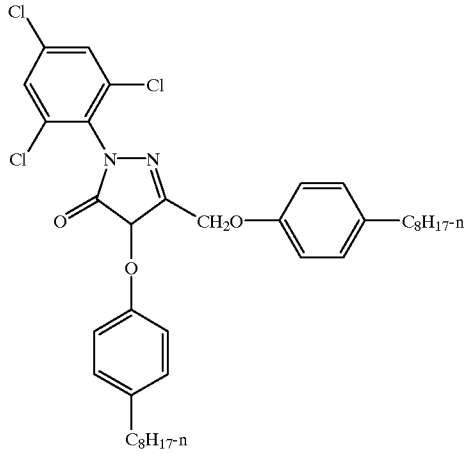

A2

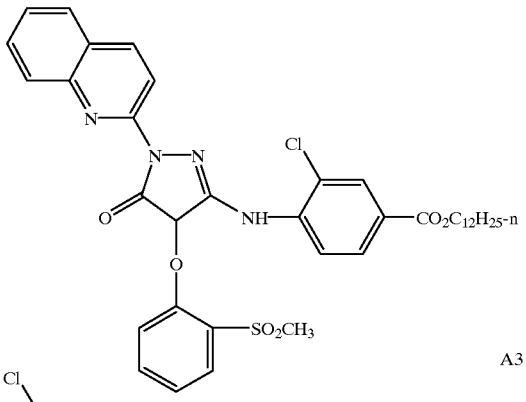

A3

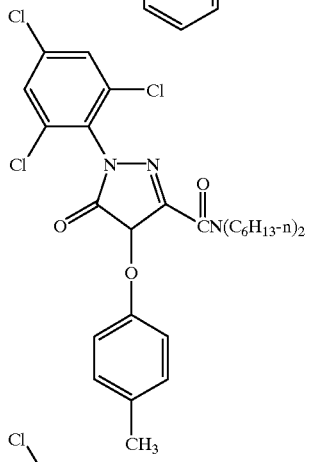

A4

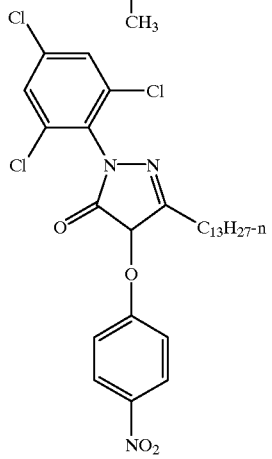

-continued
A5
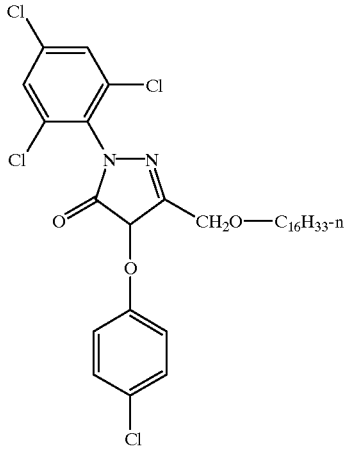
A6
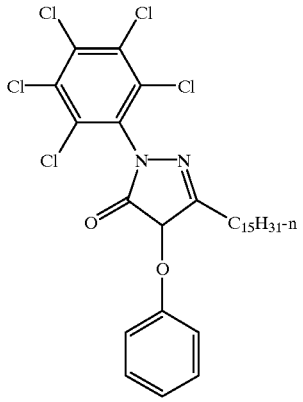
A7
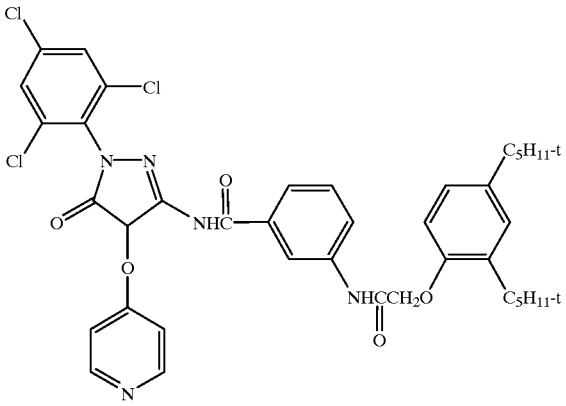
-continued
A8
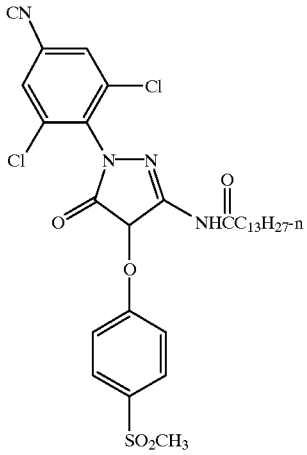
A9
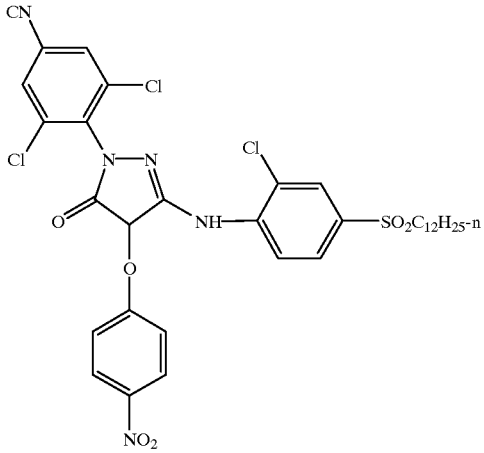
A10
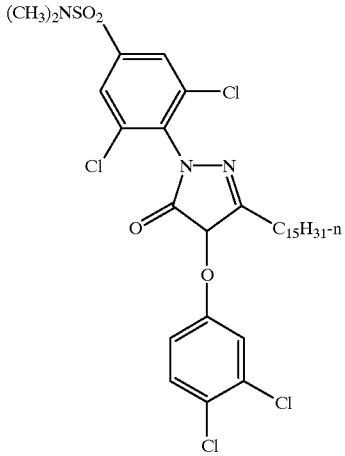

-continued
A11
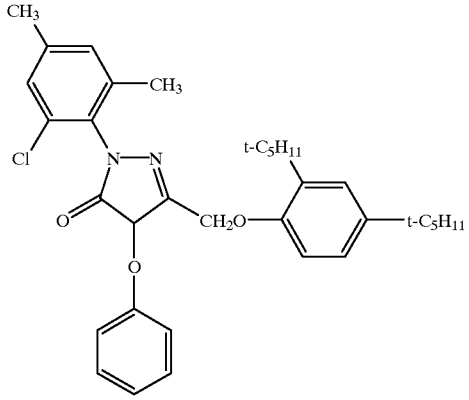
A12
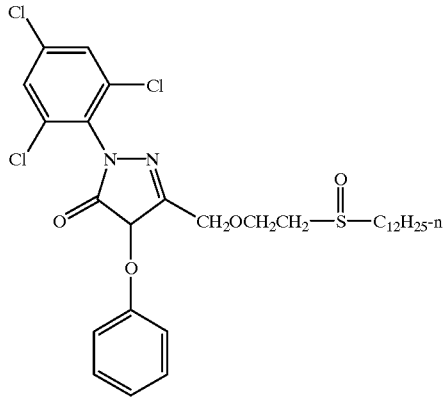
A13
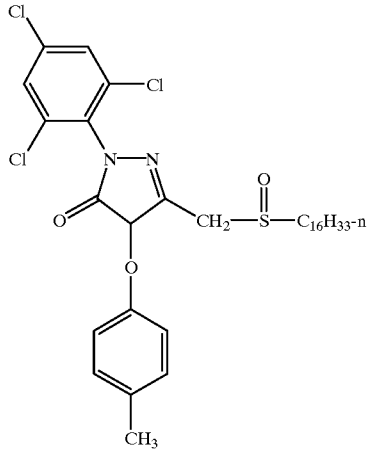
-continued
A14
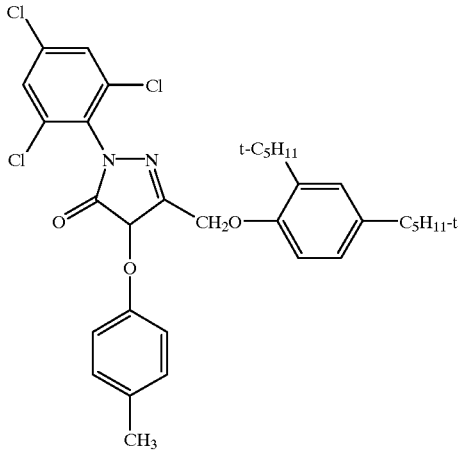
A15
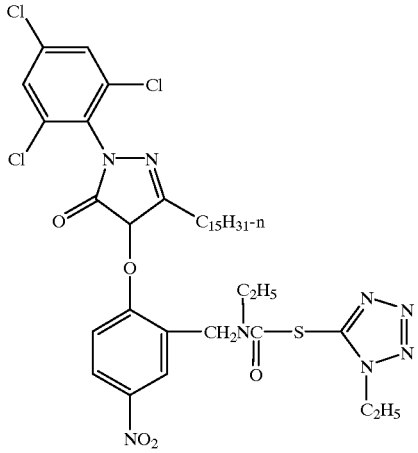
A16
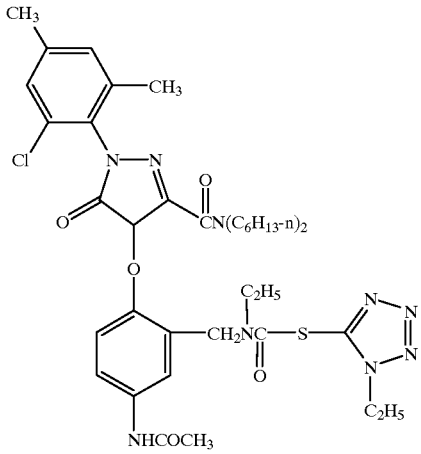

-continued
A17
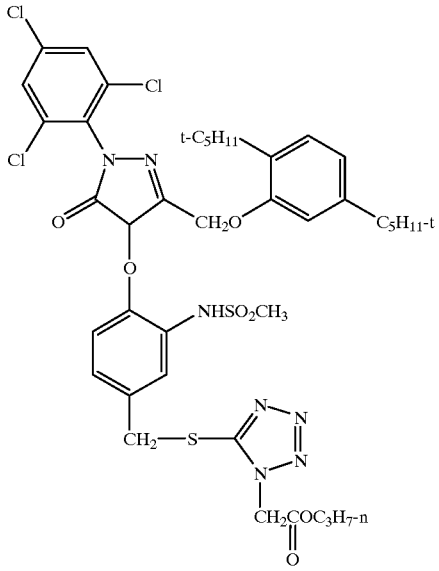
A18
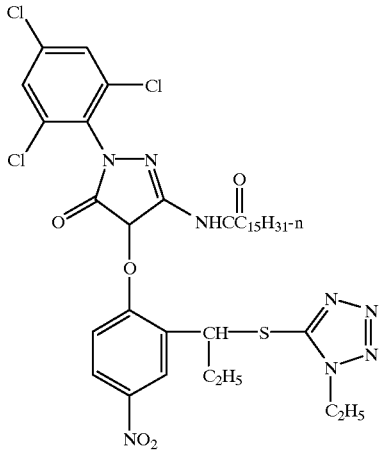
A19
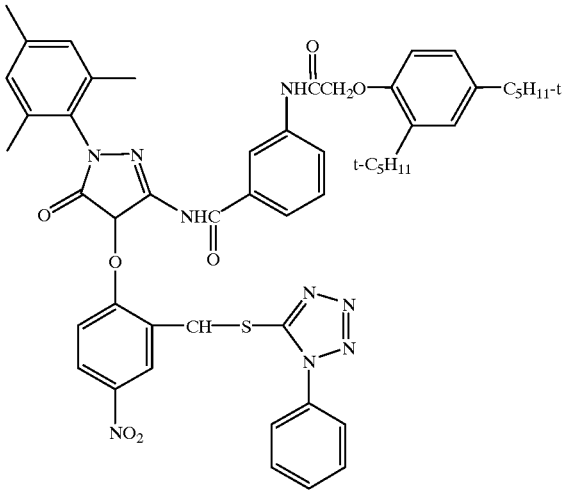
-continued
A20
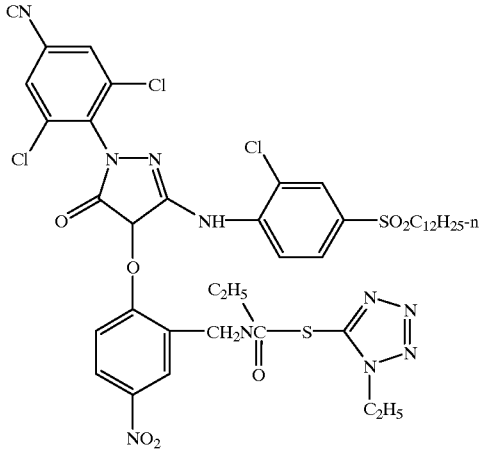
A21
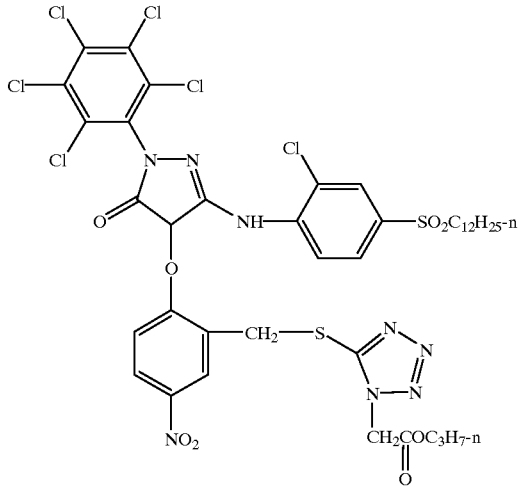
Examples of sulfide, sulfoxide and sulfone compounds useful for the practice of the present invention include, but are not limited to, S1–S26 below:
S1
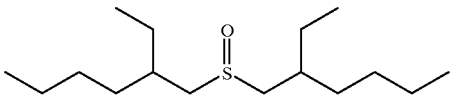
S2
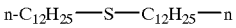
S3
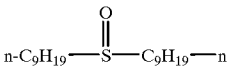
S4
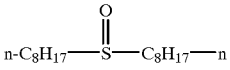
S5
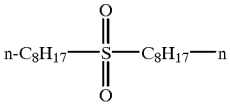

-continued

S6

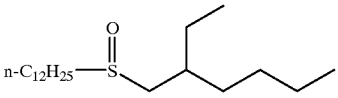

S7

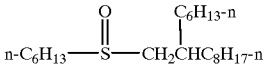

S8

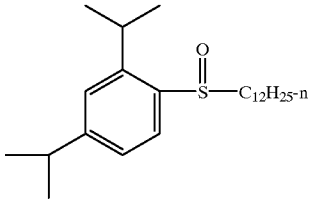

S9

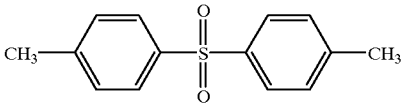

S10

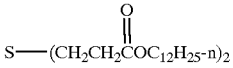

S11

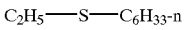

S12

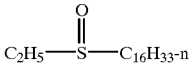

S13

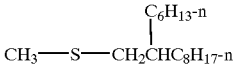

S14

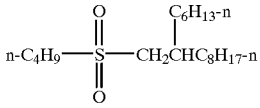

S15

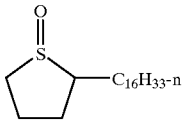

S16

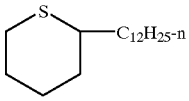

S17

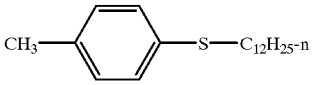

S18

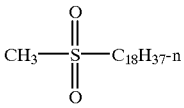

S19

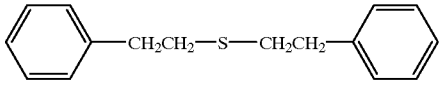

-continued

S20

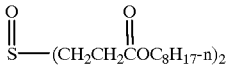

S21

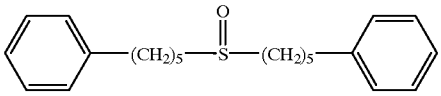

S22

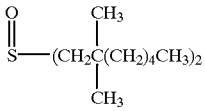

S23

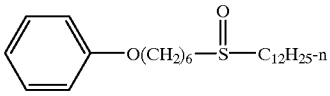

S24

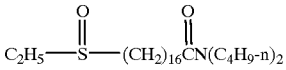

S25

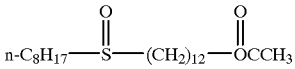

S26

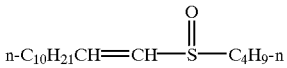

The photographic elements of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). While the order of the color sensitive layers can be varied, they will normally be red-sensitive, green-sensitive and blue-sensitive, in that order on a transparent support, with the reverse order on a reflective support being typical.

In the following discussion of suitable materials for use in elements of this invention, reference will be made to *Research Disclosure,* December 1989, Item 308119, published by Kenneth Mason Publications, Ltd., Dudley Annex, 12*a* North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N -diethylaniline hydrochloride and 4-amino-N-ethyl-N-(2-methoxyethyl)-m -toluidine di-p-toluene sulfonic acid.

With negative working silver halide a negative image can be formed. Optionally a positive (or reversal) image can be formed.

The photographic elements of the present may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP U.S. Pat. Nos. 96,570; 4,420,556; and 4,543,323.) Also, the couplers may be blocked or coated in protected form as described, for example, in Japanese Application 61/258,249 or U.S. Pat. No. 5,019,492.

In addition to the aryloxypyrazolone couplers of the present invention, the photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12*a* North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90078,230; 90-079,336; 90-079,338; 90-079,690; 90079,691; 90-080,487; 90-080,489; 90-080,490; 90080,491; 90-080,492; 90-080,494; 90-085,928; 90086,669; 90-086,670; 90-087,361; 90-087,362; 90087,363; 90-087,364; 90-088,096; 90-088,097; 90093,662; 90-093,663; 90-093,664; 90-093,665; 90093,666; 90-093,668; 90-094,055; 90-094,056; 90101,937; 90-103,409; 90-151,577.

The silver halide used in the photographic elements of the present invention may be silver bromoiodide, silver bromide, silver chloride, silver chlorobromide, silver chlorobromo-iodide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T = \mathrm{ECD}/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred to that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure,* Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., aurous sulfide) and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure, June* 1975, item 13452 and U.S. Pat. No. 3,772,031.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention may also usefully include a magnetic recording material as described in *Research Disclosure,* Item 34390, November 1992.

Photographic elements of the present invention are preferably imagewise exposed using any of the known techniques, including those described in *Research Disclosure I,* section XVIII.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977. In the case of processing a reversal color element, the element is first treated with a black and white developer followed by treatment with a color developer.

As mentioned above, the 1-aryl-4-aryloxy-2-pyrazolin-5-one coupler plus sulfide, sulfoxide or sulfone combinations of this invention may be used together with a variety of other types of couplers in the same layer or in different layers of a multilayer photographic material. Specifically contemplated is the use of the coupler plus sulfur compound combinations of this invention in one or more green-sensitive layers of a photographic material containing one or more pyrazoloazole couplers or one or more 1-phenyl-3-anilino-2pyrazolin-5-one couplers with thiophenol coupling-off groups.

As to the synthesis of the above described 1-aryl-4-aryloxy-2pyrazolin-5-one magenta couplers, the synthesis of aryloxypyrazolones where R2 in the above formulae is acylamino or anilino can be found in U.S. Pat. Nos. 3,419,391; 3,519,429 and 4,692,529. In addition, 4,692,529 and DE 4 040 472 A1 describe the synthesis of such compounds. U.S. Pat. No. 3,419,391 describes the synthesis of aryloxypyrazolones where R2 in the above formulae is an alkyl. Another synthesis for the above described 1-aryl-4-aryloxy-2pyrazolin-5-one magenta couplers which is more generally applicable, is described below in relation to the synthesis of A4.

Example of Synthesis: Compound A4

Preparation of t-butyl ethyl bromomalonate t-Butyl ethyl malonate (25.00 g, 0.13 mol) was dissolved in toluene and warmed to 80° C. To the resulting solution was added 1,3-dibromo-5,5-dimethylhydantoin (25.00 g, 0.07 mol). The reaction was stirred at elevated (80° C.) temperature 18 h. The reaction was cooled concentrated and taken up in $Et_2O$. The organic layer was washed, with sat. $NaHCO_3$ (2×), brine (3×), dried ($MgSO_4$), filtered and concentrated. Purification by filtration on silica (70:30; hept:EtOAc) yielded 33.0 g (93%) of a light yellow oil. NMR and MS indicated a mixture of three compounds SM (20%), monobrominated (55%) and dibromonated diesters (25%). The material was used without further purification.

Preparation of t-butyl ethyl-2(p-nitrophenoxy) malonate p-Nitrophenol (3.58 g, 26 mmol) was flushed with $N_2$ and dissolved in dry THF (100 ml). To the resulting solution was added potassium t-butoxide (2.52 g, 22 mmol). The resulting orange solution was stirred for 15 min. and a solution of t-butylethyl bromomalonate (5.89 g, 0.022 mol) in dry THF (20 ml) added dropwise. The reaction was stirred at room temperature for 4 h and concentrated. The residue was taken up in $Et_2O$ and the organic layer washed with $H_2O$ (1x), sat. $NaHCO_3$ (4x), brine (3x), dried ($MgSO_4$), filtered and concentrated. The resulting solid was stirred in heptane, filtered (2x) to remove t-butyl ethyl malonate contaminate and concentrated. The solid was dissolved in EtOAc (100 ml) and an aqueous solution of sodium dithionite (100 ml; $Na_2S_2O_4$ 125 g/1) added. The two phase solution is stirred 18 h. The phases are separated and the organic phase washed with $H_2O$ (2x), brine (2x), dried ($MgSO_4$), filtered and concentrated. The resulting off white solid 6.35 g (88%) is used without further purification.

Preparation of ethyl- (D-nitrophenyloxy)-malonate magnesium salt t-Butyl ethyl-2(p-nitrophenyloxy) malonate (37.2 g, 0.11 mol) was dissolved in $CH_2Cl_2$ (400 ml) and trifluoroacetic acid (100 ml) added. The reaction was stirred for 2 h and taken up in $CH_2Cl_2$. The solution was washed with $H_2O$ (3×), brine (2×), dried ($MgSO_4$), filtered and concentrated (bath temp <45° C.). The resulting oil was purified on silica gel (60A; 230–400 mesh; 70:30; hept:EtOAc then acetone) yielding 27.1 g (88%) of a white solid. The white solid was flushed with $N_2$ and dissolved in dry THF (250 ml). To the resulting solution was added $Mg(OEt)_2$ (5.33 g, 0.046 mol). The solution was stirred 18 h at room temperature and concentrated (bath temp <45° C.). The resulting foam was twice diluted with dry cyclohexane (~50 ml) and concentrated. The solid was dried under high vacuum to a free flowing off-white solid. The material was used without further purification.

Preparation of Ethyl-2(i-nitrophenyloxy)-3-oxohexadecanoate

Carbonyldiimidazole (16.7 g, 104 mmol) was flushed with $N_2$ and dissolved in dry THF (500 ml). To the resulting solution was added a solution of myrisitic acid (21.5 g, 94 mmol) in dry THF (50 ml). The reaction was stirred two hours at room temperature, then ethyl-(p-nitrophenyloxy)-malonate magnesium salt (25.0 g, 44 mmol) was added in portions over 5 minutes. The reaction is stirred at room temperature 18 h and quenched with $NH_4Cl$. The solution is concentrated and taken up in $Et_2O$. The organic layer is washed with, 1M HCl (1×), $H_2$)(2×), sat. $NaHCO_3$ (2×), brine (2×), dried ($MgSO_4$), filtered and concentrated. Purification on Silica (60A; 230–400 mesh; 80:20; hept:EtOAc) yielded 22.2 g (60%) of a light yellow oil.

Preparation of 1-(2,4,6-trichlorophenyl)-3-tridecyl-4-(4-nitrophenoxy)-5-pivaloyl pyrazole Ethyl-2(p-nitrophenyloxy)-3-p -nitrophenyloxy)-3oxohexadecanoate (19.5 g, 45 mmol) was flushed with $N_2$ and dry MeOH (50 ml) added. Approximately 10 ml THF was added to improve solubility. Trichlorophenylhydrazine (10.4 g, 49 mmol) was added followed by HCl(g) (until the reaction mixture was homogenous ca.35 sec). The reaction was stirred for 18 h, diluted with $Et_2O$ (200 ml) and filtered. The resulting solution was washed with $H_2O$ (2×), sat. $NaHCO_3$ (2×), brine (2×), dried ($MgSO_4$), filtered and concentrated. The resulting oil was flushed with $N_2$ and dissolved in $CH_2Cl_2$. Pivaloyl chloride (11 ml, 91 mmol) was added and followed by N,N-dimethylaminopyridine (cat. 0.4 g). The solution was stirred 10 min. then a solution of $Et_3N$ (14 ml, 100 mmol) in $CH_2Cl_2$ was added dropwise. The resulting black solution was stirred 1 h. and taken up in $CH_2Cl_2$. The organic portion was washed with 0.5M HCl (2×), $H_2O$ (2×), sat. $NaHCO_3$ (2×), brine (2×), dried ($MgSO_4$), filtered and concentrated. Purification on silica (60A; 230–400 mesh; 90:10; hept:EtOAc) yielded 7.4 g (25%) of a white solid.

Preparation of A4

1-(2,4,6-trichorophenyl)-3-tridecyl-4-(4-nitrophenoxy)-5-pivaloyl pyrazole (7.4 g, 11 mmol) was flushed with $N_2$ and dissolved in THF (5 ml) and dry MeOH (40 ml). $K_2CO_3$ (3.1 g, 22 mmol) was added and the reaction stirred at room temperature for 1 h. The resulting solution was taken up in $Et_2O$ and the organic portion washed with 0.5M HCl (2×), sat. $NaHCO_3$ (2×), $Na_2S_2O_4$ (125 g/1) (2×), brine (2×), dried ($MgSO_4$), filtered and concentrated yielding 5.9 g (93%) of a white solid.

EXAMPLE 1

An Illustration of the Advantageous Use of Couplers and Sulfur Compounds of the Present Invention This example illustrates the advantages of silver halide films containing 1-aryl-4-aryloxy-2-pyrazolin-5-one couplers of this invention combined with a sulfoxide compound of this invention in comparison to combinations outside the scope of this invention.

Couplers of this invention A1, A3 and A4 are dispersed and coated in combination with sulfoxide S1 of this invention. The activity and stability of these compositions are compared to compositions of the same couplers dispersed and coated with the commonly-used high-boiling coupler solvent tritolyl phosphate (mixed isomers), referred to as B1. Activity and stability data are also included for the comparison coupler C1 (structure below) dispersed and coated both in B1 and in S1.

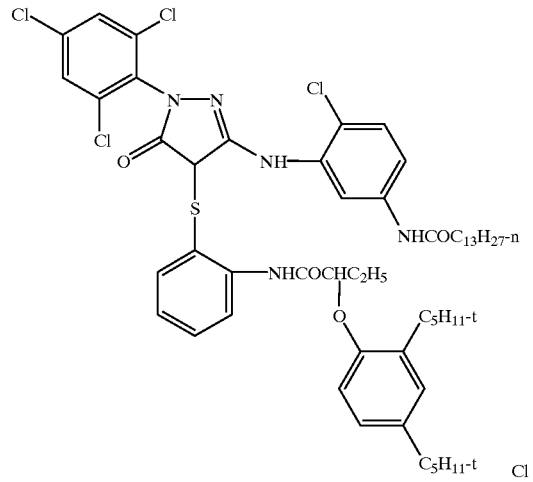

As is commonly done in the art, aqueous dispersions were prepared by adding an oil phase containing 1.0 g of coupler, 1.0 g of either B1 or S1 and 3.0 g of ethyl acetate to a solution of 3.0 g of gelatin and 0.3 g of the sodium salt of tri-isopropylnaphthalene sulfonic acid (a dispersing agent) in sufficient water to yield a total volume of 50 ml. Each of the resulting mixtures was passed through a colloid mill to disperse the coupler-containing oil phase in the aqueous phase as small particles. The resulting dispersions contained two percent by weight of coupler and two percent by weight of either B1 or S1.

Sufficient coupler to yield a laydown of 0.646 mmol/sq m was mixed with a silver iodobromide emulsion and additional gelatin and coated on cellulose acetate butyrate support as diagramed below. The ethyl acetate in the dispersions evaporates on drying. The layer containing coupler and silver halide was overcoated with a layer containing gelatin and the hardener bis(vinylsulfonylmethyl) ether, as shown in the diagram below (note: g/sq m is the same as $g/m^2$):

5.38 g/sq m Gelatin (overcoat)
0.161 g/sq m Bis(vinylsulfonylmethyl) Ether Hardener
2.69 g/sq m Gelatin
0.646 mmol/sq m Magenta Dye-Forming Coupler
B1 or S1 at Equal Weight to Coupler
1.61 g Ag/sq m as a 0.46 $\mu$m Silver Iodobromide (6.4% Iodide) Emulsion
Cellulose Acetate Butyrate Support After the films had hardened they were exposed through a step tablet on a 1B sensitometer and then subjected to a modified KODAK FLEXICOLOR C-41 color negative process, as described in detail below. Gamma values were obtained from plots of Status M green density versus log exposure both without and with 4.0 g/L of the competing coupler citrazinic acid (CZA) added to the developer. The ratio of gamma with CZA (Gamma CZA) to Gamma without CZA (Gamma) is a measure of the activity of the magenta dye-forming coupler. Values of this ratio, referred to as GAMMA RATIO, are listed in Table I.

C-41 PROCESSING SOLUTIONS AND CONDITIONS

| Solution | Processing Time | Agitation Gas |
|---|---|---|
| A) C-41 Developer | 3'15" | Nitrogen |
| or B) C-41 Developer with 4.0 g/L of CZA | 3'15" | Nitrogen |
| ECN Stop Bath | 30" | Nitrogen |
| Bleach III | 3' | Air |
| Wash | 1' | None |
| C-41 Fix | 4' | Nitrogen |
| Wash | 4' | None |
| PHOTO-FLO (a wetting agent) | 30" | None |

Processing Temperature = 100° F.

To evaluate the stability of the coupler compositions, film samples were subjected to an accelerated raw stock keeping test. The test consisted of storage of unexposed, unprocessed samples at 120° F., 50% relative humidity for 4 weeks. Samples were then exposed and processed (C-41 process without CZA) together with reference samples that had been stored in a freezer. Values of Dmax, the maximum density obtained at high exposure, were compared. Dmax values were corrected for Dmin to remove contributions to green density from the support and other coating components. The ratio of the Dmax obtained from an incubated sample (120° F., 50% RH) relative to a sample of the same film stored in a freezer is referred to as DENSITY RATIO and is listed in Table I for each coupler composition. This ratio is a measure of the raw stock stability of a film composition, with ratios approaching 1.0 being desirable.

TABLE I

| Coupler (g/sq m) | | | High-Boiling Solvent | GAMMA RATIO (Activity) | DENSITY RATIO (Stability) |
|---|---|---|---|---|---|
| Comparison | C1 | (0.671) | B1 | 0.67 | 0.96 |
| Comparison | C1 | (0.671) | S1 | 0.56 | 0.95 |
| Comparison | A1 | (0.443) | B1 | 0.75 | 0.32 |
| Invention | A1 | (0.443) | S1 | 0.72 | 0.87 |
| Comparison | A3 | (0.376) | B1 | 0.42 | 0.34 |
| Invention | A3 | (0.376) | S1 | 0.65 | 1.00 |
| Comparison | A4 | (0.377) | B1 | 0.71 | 0.46 |
| Invention | A4 | (0.377) | S1 | 0.66 | 0.87 |

It is evident from the GAMMA RATIO values in Table I that the 1-aryl-4-aryloxy-2pyrazolin-5-one plus sulfoxide compositions of this invention can show high activity and high dye-forming ability The composition containing A1 and S1 is more active than either composition containing comparative coupler C1. In some cases, as with A3 or A4, the use of S1 as a high-boiling solvent in place of B1 can improve coupler activity. While the use of S1 with coupler C1 is unnecessary (stability is good even with B1), the use of S1 with couplers A1, A3 and A4 of this invention dramatically improves coupler raw stock stability, as indicated by the DENSITY RATIO values with S1 versus B1. Thus, the use of sulfoxides in combination with 1-aryl-4-aryloxy-2pyrazolin-5-one couplers allows the construction of stable photographic materials containing active magenta dye-forming imaging couplers or inhibitor-releasing couplers.

EXAMPLE 2

Additional Comparison of Magenta Dye-Forming Coupler Compositions of This Invention with other Magenta Dye-Forming Compositions For this example, dispersions and coatings were prepared by procedures similar to those described in Example 1. Exposed films were again subjected to a C-41 process as described in Example 1. The ratio of coupler to high-boiling solvent was again 1:1. In this case Dmax values for samples subjected to preexposure/preprocess incubation for two weeks at 100° F. were compared to Dmax values for samples stored in a freezer for the same period before being exposed and processed. The Dmax values were corrected for Dmin as in Example 1. The Dmax ratio for each pair is reported in Table II. Again a ratio approaching unity is desirable. It is apparent from the data in Table II that the raw stock stability of the film containing Coupler A1 of this invention is greatly improved from a ratio of 0.68 with conventional high-boiling solvent B1 to 0.96 with sulfoxide S1 of this invention. Coupler A2 of this invention is very unstable in combination B1 (ratio=0.13), but the stability improves substantially in combination with S1 and even further in combination with sulfide S2 of this invention.

TABLE II

| Coupler | High-Boiling Solvent | | Dmax 2 wk 100° F. 50% RH / Dmax 2 week Freezer |
|---|---|---|---|
| C1 | B1 | (Comparison) | 0.99 |
| C1 | S1 | (Comparison) | 0.95 |
| A1 | B1 | (Comparison) | 0.68 |
| A1 | S1 | (Invention) | 0.96 |
| A2 | B1 | (Comparison) | 0.13 |
| A2 | S1 | (Invention) | 0.49 |
| A2 | S2 | (Invention) | 0.79 |

EXAMPLE 3

Use of Coupler A1 of This Invention with Additional Sulfur Compounds of This Invention.

For this example coupler A1 of this invention was coated with comparative high-boiling solvents B1 and oleyl alcohol (B2) and with a variety of sulfur compounds of this invention, either alone or as mixtures with B2. Dispersion preparation and coating procedures were similar to Example 1, but A1 was coated at laydown of 0.215 g/sq m, and a tabular (0.57 μm×0.09 μm) silver bromoiodide emulsion (6% iodide) was used at a laydown of 0.538 g/sq m of silver. For this example, Dmax values are compared for films incubated for four weeks at 100° F., 50% relative humidity ("RH") prior to exposure and processing and for films stored in a freezer for the same time period prior to exposure and processing. The Dmax values were corrected for Dmin as in the previous examples. The various coating compositions and the Dmax ratios obtained after incubation relative to freezer storage are listed in Table III. The data in Table III demonstrate the stability improvements obtained by combining a 1-aryl -4-aryloxy-2pyrazolin-5-one coupler of this invention with sulfides, sulfoxides or sulfones of this invention either alone or mixed with other high-boiling solvents.

TABLE III

| Dispersion Components | Ratio A1:Solvent(s) | Dmax 4 wk 100° F., 50% RH Dmax 4 wk Freezer |
|---|---|---|
| A1 + B1 | 1:1 | 0.25 |
| A1 + S1 | 1:1 | 0.96 |
| A1 + S2 | 1:1 | 0.96 |
| A1 + B1 + S1 | 1:0.5:0.5 | 0.82 |
| A1 + B2 | 1:1 | 0.58 |
| A1 + B2 + S1 | 1:0.5:0.5 | 0.85 |
| A1 + B2 + S3 | 1:0.5:0.5 | 0.83 |
| A1 + B2 + S9 | 1:0.5:0.5 | 0.81 |

EXAMPLE 4

Comparison of Combinations of Coupler A1 with Sulfoxide Compounds of this Invention with a C1 Plus S1 Combination and an A1 Plus B1 Combination.

For this comparison, Coupler C1 was coated together with sulfoxide S1, while coupler A1 was coated with B1 as well as with a variety of sulfoxide compounds of this invention. The dispersion preparation, coating, incubation, exposure and processing conditions were similar to Example 1. Table III lists measured GAMMA RATIO values and DENSITY RATIO values as defined in Example 1. In addition, ratios of Dmax values obtained from samples incubated for four weeks at 100° F. 50% RH prior to exposure and processing to the Dmax values obtained from samples stored in a freezer for the same period prior to exposure and processing are given in Table IV. The improved GAMMA RATIO values provided by coupler A1 of this invention are evident from the data in Table IV as is the improved raw stock stability provided by the inventive combinations of A1 plus sulfur-containing compounds.

TABLE IV

| Coupler | High-Boiling Solvent | | GAMMA RATIO | DENSITY RATIO | Dmax 4 wk 100° F., 50% RH Dmax 4 wk Freezer |
|---|---|---|---|---|---|
| C1 | S1 | (Comparison) | 0.62 | 1.00 | 1.00 |
| A1 | B1 | (Comparison) | 0.78 | 0.30 | 0.51 |
| A1 | S1 | (Invention) | 0.82 | 0.97 | 0.98 |
| A1 | S6 | (Invention) | 0.78 | 0.93 | 0.97 |
| A1 | S7 | (Invention) | 0.79 | 0.95 | 0.99 |
| A1 | S8 | (Invention) | 0.77 | 0.88 | 0.95 |

The invention has been described in detail with particular reference to preferred embodiments, but it will be understood that variations and modifications can be effected within the spirit and scope of the invention.

What is claimed is:

1. A photographic element having a layer comprising a silver halide emulsion, and a 1-aryl-4-aryloxy-2-pyrazolin-5-one magenta dye forming coupler which has a sulfoxide group, wherein the magenta dye forming coupler is of formula Ia or Ib:

Ia

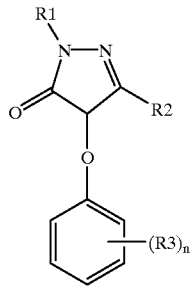

Ib

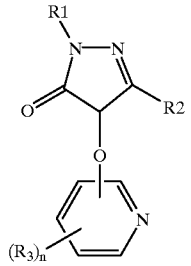

wherein:

R1 is an aryl group;

R2 is an alkyl group, an acylamino group, an anilino group, a carbamoyl group or an alkoxy group:

R3 is a substituent; and n is an integer from 0 to 4;

at least one of R1, R2 or R3 carrying the sulfoxide group; the substituents on the sulfoxide group being selected from an alkyl group; an alkylene group; an alkenyl group; or a substituted or unsubtituted aryl wherin the subtituents are selected from an alkyl, alkoxy, aryloxy, alkoxycaronyl, arylcarbonyl, acyloxy, carbonamido, carbamoyl, sulfonamido, or sulfamoyl group, or halogen atoms; or the substituents may together form a ring including the sulfur atom; the total number of carbon atoms on the substituents together being at least 12.

2. A photographic element having a layer comprising a silver halide emulsion, a 1-aryl-4-aryloxy-2-pyrazolin-5-one magenta dye forming coupler, and a separate sulfoxide compound, wherein the magenta dye forming coupler has structure Ia or Ib, and the sulfoxide compound is of structure S1, S2, S6, S7, or S8 shown below:

Ia

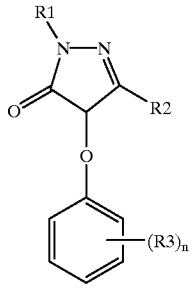

Ib

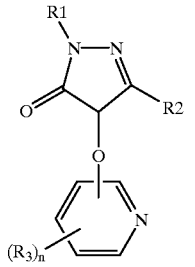

wherein:

R1 is an aryl group;

R2 is an alkyl group, an acylamino group, an anilino group, a carbamoyl group or an alkoxy group;

R3 is a substituent; and n is an integer from 0 to 4;

S1

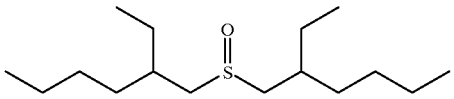

S2

S6

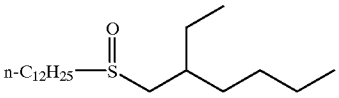

S7

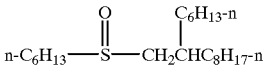

S8

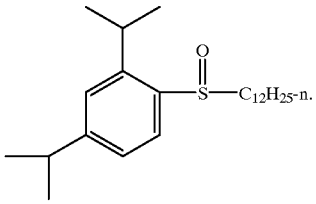

3. A photographic element having a layer comprising a silver halide emulsion, a 1-aryl-4-aryloxy-2-pyrazolin-5-one magenta dye forming coupler, and a separate sulfide, sulfoxide or sulfone compound, wherein the magenta dye forming coupler has structure Ia or Ib, and the sulfide, sulfoxide or sulfone compounds have structures VI, VII and VIII, respectively:

Ia

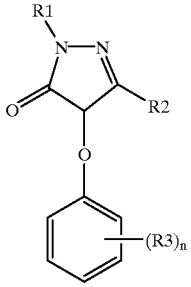

Ib

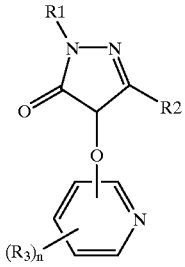

wherein:

R1 is an aryl group;

R2 is an alkyl group, an acylamino group, an anilino group, a carbamoyl group or an alkoxy group;

R3 is a substituent; and n is an integer from 0 to 4;

VI

VII

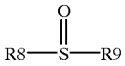

VIII

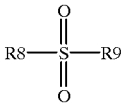

wherein R8 and R9 are individually selected from unsubstituted alkyl groups, the total number of carbon atoms in R8 and R9 together being at least 12.

* * * * *

UNITED STATES PATENT AND TRADEMARK OFFICE

CERTIFICATE OF CORRECTION

PATENT NO. : 6,365,334 B1
DATED : April 2, 2002
INVENTOR(S) : Jerrold N. Poslusny et al.

It is certified that error appears in the above-identified patent and that said Letters Patent is hereby corrected as shown below:

Column 24,
Line 60, change “alkoxycaronyl” to -- alkoxycarbonyl --.
Line 61, change “arylcarbonyl” to -- aryloxycarbonyl --.

Signed and Sealed this

Fourth Day of February, 2003

JAMES E. ROGAN
*Director of the United States Patent and Trademark Office*